US005730640A

United States Patent [19]

Acx et al.

[11] Patent Number: 5,730,640

[45] Date of Patent: Mar. 24, 1998

[54] WIRE REINFORCEMENT FOR WOMEN'S CLOTHING

[75] Inventors: Filip Acx, Wevelgem; Ludo Adriaensen, Deerlijk; Paul Balcaen, Otegem, all of Belgium

[73] Assignee: N.V. Bekaert S.A., Zwevegem, Belgium

[21] Appl. No.: 669,311

[22] PCT Filed: Dec. 28, 1994

[86] PCT No.: PCT/EP94/04325

§ 371 Date: Oct. 29, 1996

§ 102(e) Date: Oct. 29, 1996

[87] PCT Pub. No.: WO95/19114

PCT Pub. Date: Jul. 20, 1995

[30] Foreign Application Priority Data

Jan. 12, 1994 [BE] Belgium ..... 9400038
Apr. 8, 1994 [BE] Belgium ..... 9400368

[51] Int. Cl.[6] ..... A41C 3/10; A41C 3/12; A41C 3/14

[52] U.S. Cl. ..... 450/41; 2/255; 2/256; 2/258; 450/51; 450/52; 450/93; 450/92

[58] Field of Search ..... 2/255, 256, 257, 2/258, 259, 260, 260.1, 261, 262, 263, 264, 73, 67; 450/41, 42, 43, 44, 45, 46, 47, 48, 49, 50, 51, 52, 143, 144, 53, 93, 92

[56] References Cited

U.S. PATENT DOCUMENTS

| | | | |
|---|---|---|---|
| Re. 22,771 | 7/1946 | Licht | 450/52 |
| 3,747,606 | 7/1973 | Tareau | 2/257 |
| 5,472,366 | 12/1995 | Moore | 450/41 |

FOREIGN PATENT DOCUMENTS

| | | | |
|---|---|---|---|
| 1048542 | 1/1959 | Germany | 450/52 |

*Primary Examiner*—Jeanette E. Chapman
*Attorney, Agent, or Firm*—Foley & Lardner

[57] ABSTRACT

A wire reinforcement for women's garments designed to support the breasts exhibits an axial cross section with a long axis and a short axis perpendicular to the long axis. The long axis has a length, and the short axis has a center thickness which is smaller than half of the length. Along the long axis, the cross section has a left end with a left thickness and a right end with a right thickness. Both the left thickness and the right thickness are substantially greater than the center thickness. Such a wire reinforcement is very rigid in the direction of the long axis and is flexible in the other directions and in relation to torsional stresses.

4 Claims, 3 Drawing Sheets

WIRE REINFORCEMENT FOR WOMEN'S CLOTHING

FIELD OF THE INVENTION

The invention relates to a wire reinforcement for women's garments designed to support the breasts, such as brassieres, swimming suits, sports clothing, one-piece outfits, etc. Normally speaking, the wire reinforcement takes the form of a U-shaped frame.

Such a wire reinforcement must meet the following requirements.

First, in order to have a sufficient bracing effect, the wire reinforcement must exhibit a certain rigidity in the plane of the frame.

Secondly, the wire reinforcement must be flexible enough to move easily with and not hinder the body movements of the person wearing it.

Thirdly, the wire reinforcement must feel comfortable for the wearer.

DESCRIPTION OF THE PRIOR ART

A number of wire reinforcements are already known in the prior art.

A first wire reinforcement has a round cross section. In order to fulfil the first requirement of sufficient rigidity, however, the diameter of the wire has to be so large that the second requirement of flexibility cannot be fulfilled. Conversely, if we attempt to decrease the diameter in order to attain the required flexibility, then the wire reinforcement lacks the required rigidity.

To correct this problem, wire reinforcements with an essentially rectangular or flat cross section have come onto the market. Such wires produce sufficient rigidity in the direction of the long axis and at the same time are flexible in the direction of the short axis. Rectangular wires with cross sections displaying 90° angles are certainly to be avoided because they are uncomfortable. But even flat wires with their rounded naturally rolled edges do not always feel comfortable.

This latter disadvantage can be remedied by wire reinforcements having an elliptical or oval cross section. These have no sharp or right angles whatsoever and therefore fulfil the third requirement of feeling comfortable. The reinforcement in the direction of the long axis is sufficient, but the flexibility in the direction of the short axis is sometimes less than desired.

Other existing wire reinforcements exhibit a cross section with a rounded side on one side because of the third requirement of comfort. The other side is flat or hollow. The rigidity in the direction of the long axis, however, is not always sufficient in this case. Another disadvantage is that this profile is not symmetric and therefore two different frames are needed, a left one and a right one.

SUMMARY OF THE INVENTION

The object of the invention is to avoid the disadvantages of the prior art and to provide a wire reinforcement that possesses sufficient rigidity in the plane of the frame, exhibits sufficient flexibility, and at the same time meets the requirements of comfort. Another object of the present invention is to provide a stable and economical way of manufacturing a profile wire.

A first aspect of the invention provides a wire reinforcement for women's garments designed to support the breasts.

The wire reinforcement displays an axial cross section with a long axis and a short axis perpendicular to the long axis. The long axis has a well-defined length and the short axis has a center thickness that is smaller than half the length of the long axis. The cross section has a profile resembling an I-shape: The left end of the long axis has a left thickness and the right end of the long axis has a right thickness. Both the left thickness and the right thickness are substantially greater than the center thickness.

The terms 'long axis' and 'short axis' do not necessarily indicate that the cross section is symmetrical in relation to these axes. A profile that is symmetrical in relation to the long axis and the short axis is indeed preferable since then only one type of frame needs to be made for both the left and the right breast; however, an asymmetrical profile is also possible.

The ratio of center thickness to right thickness, as well as of center thickness to left thickness, is preferably between 0.6 and 0.8. The maximum limit is set at 0.8; otherwise there is not a sufficient difference from a rectangular profile. The minimum limit of 0.6 is determined for reasons of an economically feasible manufacturing process. Lower limits are possible, but are more expensive to achieve.

Such a wire reinforcement according to the invention hardly loses any of its rigidity in the direction of the long axis in comparison with a wire reinforcement having a rectangular cross section and a long axis of the same length. Such a wire reinforcement is even more rigid in the direction of the long axis than a wire reinforcement having a rectangular cross section of the same surface area.

In the direction of the short axis, i.e. perpendicular to the long axis, the flexibility is considerably increased in comparison with a similar wire reinforcement having a rectangular cross section; this is due to the smaller thickness in the center. Torsional stresses also encounter less resistance because of this smaller thickness in the center.

The length of the long axis of the cross section is usually between 1.5 and 4.0 mm. The center thickness is usually between 0.25 and 1.0 mm, for example between 0.30 and 0.60 mm.

By preference, the cross section of the wire reinforcement displays a flat portion in the middle that is parallel with the long axis and has a thickness equal to the center thickness over a distance greater than 0.2 mm, preferably greater than 0.5 mm and most preferably greater than half of the length. Such a cross section has the advantage of making a stable production process possible, as well as of enabling the production of small center thicknesses.

A preferred embodiment has a cross section that both on the left and the right ends displays a flat portion that is perpendicular to the long axis. This embodiment has the advantage that it can be made with the aid of the so-called Turks heads, which are known as such in the prior art.

By preference, the wire reinforcement is rounded off so that the cross section has no sharp corners, thus resulting in a comfortable feel and a lack of encumbrance for the wearer. Such a rounded cross section is called a 'rounded I-profile' in what follows.

According to a second aspect of the invention a method is provided for producing a wire reinforcement for women's garments that are designed to support the breasts. The method comprises the following steps:

(i) cold drawing a wire to its final diameter;

(ii) rolling the cold-drawn wire into a flat wire;

(iii) profile rolling the flat wire into a rounded I-profile and creating a flat portion parallel with the long axis in the center of the cross-section.

By preference, step (iii) is carried out with the aid of Turks heads.

Subsequently, the method can further include the following step of coating the rounded I-profile with a corrosion-proof coating layer of a synthetic material and/or zinc.

BRIEF DESCRIPTION OF THE DRAWINGS

The invention will now be further explained by way of reference to the accompanying drawings in which.

DETAILED DESCRIPTION OF A PREFERRED EMBODIMENT

Figure 1:
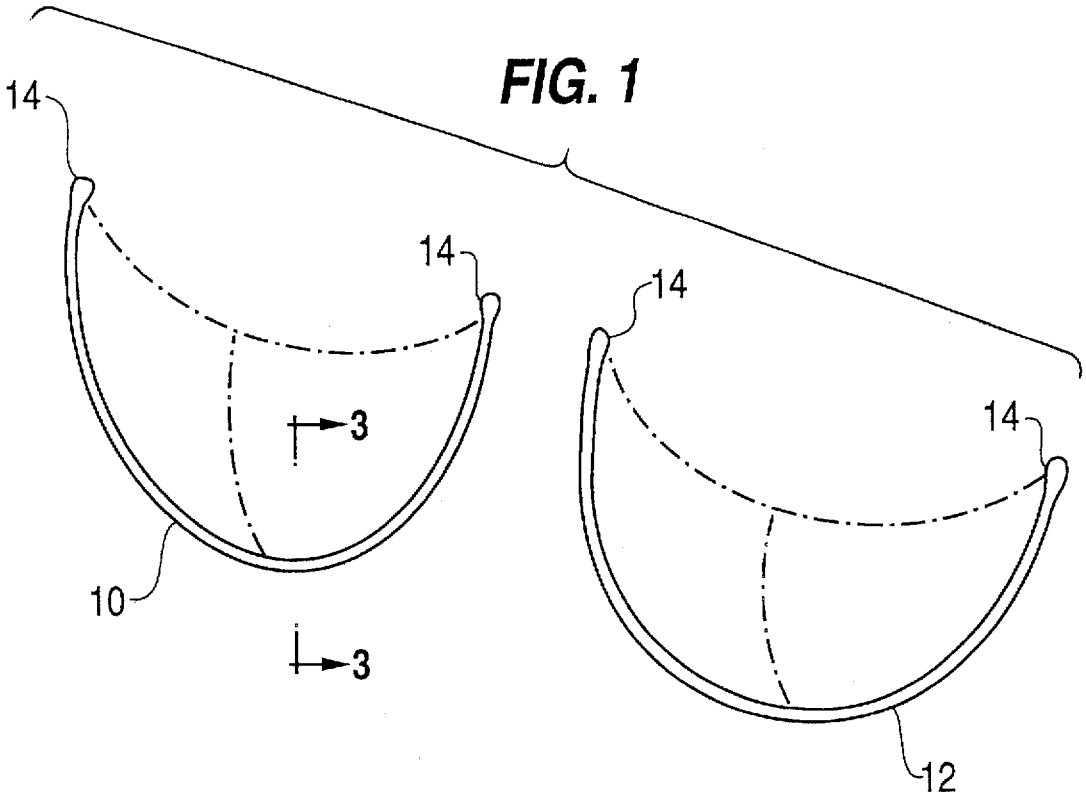
FIGS. 1 and 2 show schematically where a wire reinforcement according to the invention is usually built into a garment.

Garments designed to support women's breasts usually comprise two roughly U-shaped wire reinforcement frames 10 and 12, as shown in FIG. 1.

This U-shape is usually not symmetrical. The left frame 10 generally differs from the right frame 12 and, consequently, if the wire reinforcement does not have a symmetrical cross section then two different frames do in fact need to be produced. If the cross section is symmetrical, then in most cases the left frame 10 need simply be turned around to form a right frame, and vice versa.

The wire reinforcements 10 and 12 have a 'rounded I-profile' 18 over the length of the wire reinforcement, except perhaps at the terminal ends of the frame where an attachment can be made to the garment or possibly to a bridging piece joining the two frames.

Figure 2:
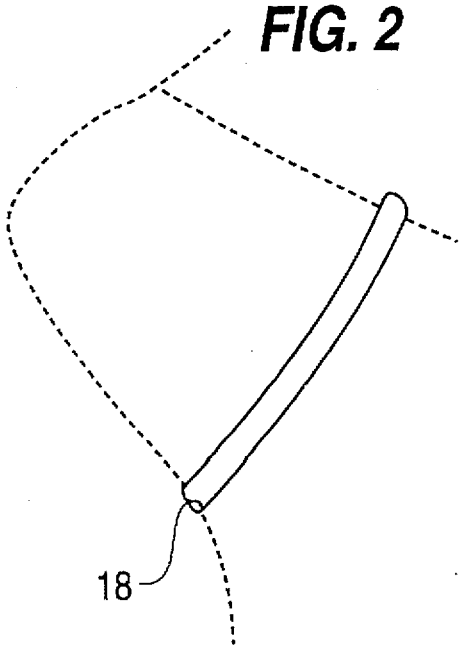

FIGS. 1 and 2 show the place where the wire reinforcement is usually located, viz. against the body under the breasts. The long axis of the rounded I-profile is oriented roughly parallel with the body of the wearer, such that an increased flexibility is achieved in a direction perpendicular to this axis. A rounded I-profile also offers little resistance to torsion and hence is very flexible in this regard.

Consequently, a rounded I-profile can easily follow all the movements of the wearer. Another consequence is that there is little chance that a frame with a rounded I-profile cross section will pierce through its textile encasement over time.

Figure 3:
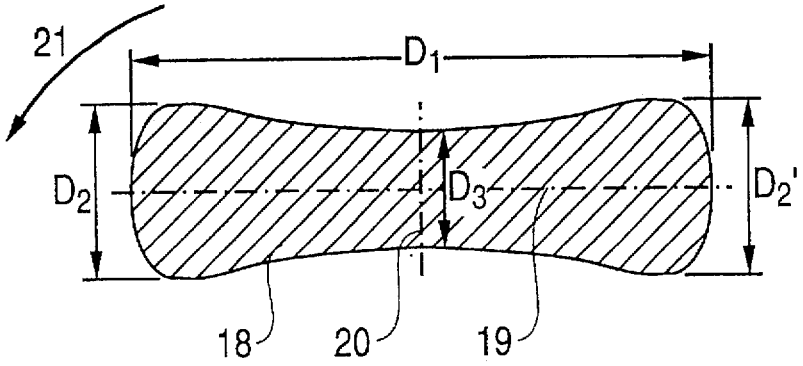
FIGS. 3 and 4 show cross sections of a wire reinforcement according to the invention.

FIG. 3 shows an enlarged cross section 18 of a rounded I-profile of a wire reinforcement according to the invention.

The length $D_1$ of the large axis 19 is equal to 2.10 mm, the right thickness $D_2$ is equal to 0.61 mm, the left thickness $D_2'$ is equal to 0.62 mm, and the center thickness $D_3$ along the short axis 20 is equal to 0.45 mm. The surface area S of the cross section is equal to 1.094 $mm^2$.

Possible dimensions of other cross sections of wire reinforcements according to the invention are as follows (where it is assumed that $D_2=D_2'$):

$D_1 \times D_2 \times D_3 = 2.0 \times 0.60 \times 0.40$
$2.0 \times 0.60 \times 0.45$
$2.50 \times 0.50 \times 0.30$
$2.50 \times 0.50 \times 0.35$
$3.15 \times 0.60 \times 0.45$ More generally, the length $D_1$ varies from 1.50 mm to 4.0 mm, the left and right thicknesses $D_2$ from 0.40 to 1.30 mm, and the center thickness $D_3$ from 0.25 to 1.0 mm.

Figure 4:
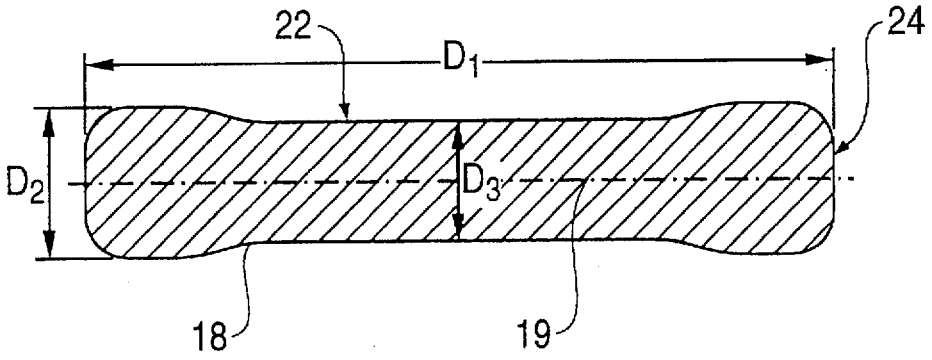

FIG. 4 shows another cross section of a preferred embodiment of a wire reinforcement according to the invention. The length $D_1$ is equal to 3.2 mm, the right thickness $D_2$ is equal to 0.60 mm, the left thickness $D_2'$ is equal to 0.59 mm, and the center thickness is equal to 0.45 mm. The surface area of the cross section is equal to 1.496 $mm^2$.

In comparison with the cross section shown in FIG. 3, the cross section of FIG. 4 shows two noticeable differences. A first difference is that there is a flat portion 22 in the middle extending for a distance of more than half of the length $D_1$. The thickness of this flat portion 22 is the same as that of the center thickness $D_3$. For a length of 3.2 mm, for example, the length of the flat portion 22 can be between 1.6 and 2.5 mm, by preference between 1.7 and 2.2 mm.

Such a flat portion makes a stable production process possible.

A second difference is that there are also flat portions 24 visible—though smaller than the aforementioned ones—on both of the ends. These flat portions 24 are situated roughly perpendicular to the long axis 19. The flat portions 24 make a stable production process possible with the aid of Turks heads.

A steel wire reinforcement with a rounded I-profile can be produced as follows: A steel wire with a carbon content of between 0.70 and 0.80 percent by weight and a perlitic structure is drawn to a diameter of between 1.15 and 1.45 mm. Thereafter the still round steel wire is passed through a number of rolling presses, the last of which are of the profiled type which impart the desired rounded I-profile to the steel wire.

Figure 5:
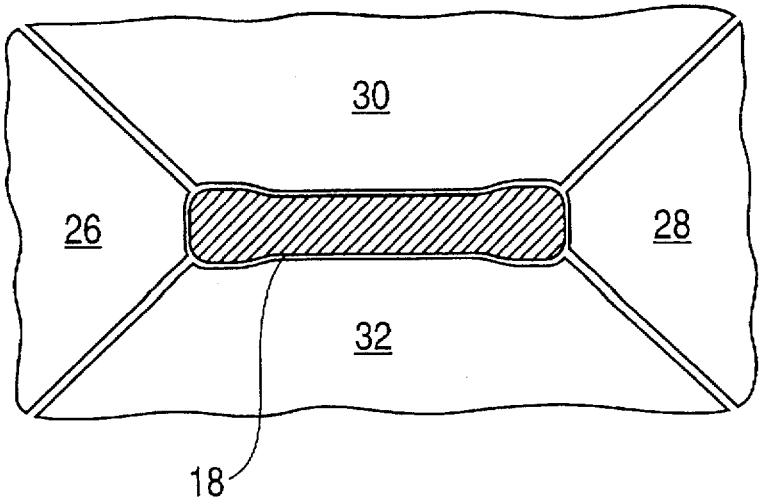
FIG. 5 shows schematically how a wire reinforcement according to the invention is produced.

With reference to FIG. 5, the final pass through the rolling press can be done with Turks heads 26, 28, 30 and 32. Turks heads 26 and 28 have a conventional flat portion, but Turks heads 30 and 32 have a particular profile corresponding to the desired profile of the wire reinforcement 18.

The breaking strength of the profile wire $F_m$ produced in this manner and represented in FIG. 3 is equal to 2,030 Newtons and the tensile strength $R_m$ is equal to 1,856 MPa (1 MPa=1 MegaPascal=1 Newton/$mm^2$).

The breaking strength of the profile wire $F_m$ produced in this manner and represented in FIG. 4 is equal to 3,050 Newtons and the tensile strength $R_m$ is equal to 2,039 MPa (1 MPa=1 MegaPascal=1 Newton/$mm^2$).

More generally, the carbon content of the steel wire can vary between 0.25% and 0.85%.

More generally, the tensile strength $R_m$ can vary throughout a range extending from 1300 MPa through 1500 MPa and 1700 MPa up to 1900 MPa, and even to 2300 MPa, depending on the production method used and the composition of the steel.

The profile wire thus obtained can still be coated with a metallic coating layer such as zinc or a zinc alloy, or else coated with a layer of synthetic material such as nylon, PET, PVC, etc. Both coating layers can also be applied to the same profile wire: first a zinc coating layer and, above it, a layer of synthetic material. In the case of galvanizing, the zinc layer can be applied either by an electrolytic or a hot-dip process. The zinc weights obtained vary between 10 and 70 g/$m^2$, for example between 20 and 50 g/$m^2$.

Figure 6:
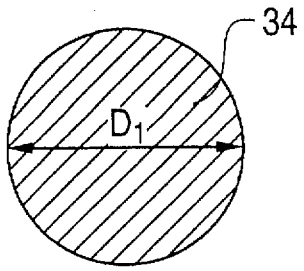
FIGS. 6, 7, 8 and 9 show cross sections of wire reinforcements according to the prior art.

FIG. 6 shows a known wire reinforcement according to the prior art with a circular shaped cross section 34. The diameter $D_1$ is 1.48 mm.

Figure 7:
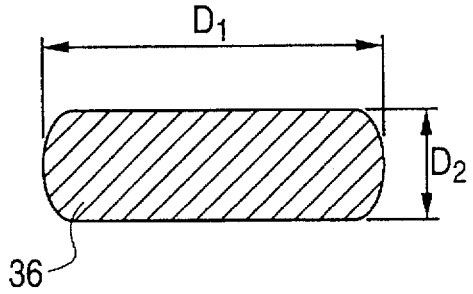

FIG. 7 shows a known wire reinforcement according to the prior art with a flat cross section 36. The length $D_1$ is 1.90 mm and the thickness $D_2$ is 0.58 mm.

Figure 8:
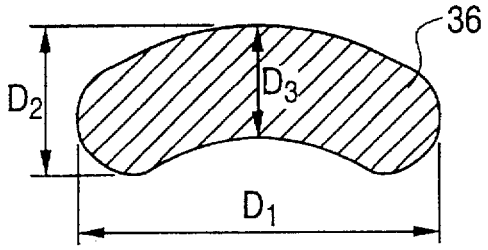

FIG. 8 shows another known wire reinforcement according to the prior art with a 'bean-shaped' cross section 38 having a convex and a concave side. The dimensions $D_1 \times D_2 \times D_3$ are 1.70×0.62×0.55 (all in mm).

Figure 9:
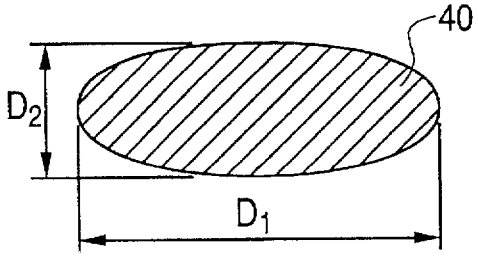

Finally, FIG. 9 shows yet another known wire reinforcement according to the prior art, now with an oval cross section 40. The dimensions $D_1 \times D_2$ are 1.8×0.91 mm.

A wire reinforcement according to the invention, viz. the one shown in FIG. 3, was compared in a test with the known wire reinforcements which are shown in FIGS. 6, 7, 8 and 9.

The rigidity in the direction of the long axis 19, the rigidity in the direction of the short axis 20 and the moment of torsion in the direction of the arrow 21 in FIG. 3 were measured for the five wire reinforcements.

The rigidity was measured with a standard three point bending test. The distance between the two points of support was 20 mm. The pressure speed was 10 mm/min. The curvature radius of the pressure point was 2.5 mm. The curvature radius of the points of support while the rigidity was being measured in the direction of the long axis was 1 mm, while the points of support were rectangular during the measurement of the rigidity in the direction of the short axis.

The torsion test for determining the moment of torsion was carried out on a wire sample with a length of 30 mm. The torsion speed was 1 revolution/min. The moment of torsion reported is the moment of torsion for an angular rotation of 100°.

The table below shows the values found:

TABLE

| wire reinforcement according to Figure | invention 3 | prior art 6 | 7 | 8 | 9 |
|---|---|---|---|---|---|
| rigidity factor $C_1$ direction long axis (N/mm) | 374.5 | 250.5 | 233.5 | 205.0 | 261.0 |
| rigidity factor $C_2$ direction short axis (N/mm) | 24.8 | 250.5 | 33.4 | 29.6 | 170.6 |
| $C_1/C_2$ | 15.1 | 1 | 7 | 6.9 | 1.5 |
| moment of torsion (Nmm) | 185 | 642 | 260 | 227 | 501 |
| maximum stress (MPa) | 712 | 2512 | 1000 | 870 | 1922 |

The rounded I-profile according to the invention offers the greatest resistance to bending in the direction of the long axis. The rounded I-profile offers the least resistance to bending in the direction of the short axis.

This comes clearly to expression in the values of the rigidity factors $C_1$ and $C_2$.

More generally, with a rounded I-profile according to the invention the ratio of the first rigidity factor to the second rigidity factor $C_1/C_2$ is greater than 10, preferably greater than 12, and most preferably greater than 15.

Delamination (*) occurred in the torsion test involving the round wire with circular cross section (FIG. 6). This means that without this delamination the moment of torsion and the maximum stress could have been even higher.

The rounded I-profile offers the least resistance to torsion, and under torsional loads it exhibits internal stresses which are clearly lower than the internal stresses thus produced in the other cross sections.

More generally, with an angular rotation of 100° a rounded I-profile has a moment of torsion which is lower than 210 Nmm, and preferably lower than 200 Nmm.

We claim:

1. A method for producing a wire reinforcement for women's garments designed to support the breasts, said method comprising the following steps:

cold drawing a wire to its final diameter;

rolling the cold-drawn wire into a flat wire; and profile rolling the flat wire into a rounded I-shaped wire reinforcement, said profile rolling creating a flat portion in a center of the cross-section of the flat wire.

2. The method according to claim 1, further comprising the following step:

starting from a pearlitic steel wire.

3. The method according to claim 1, wherein said profile rolling is done by means of Turk heads.

4. The method according to claim 1, further comprising the following step:

coating said rounded I-shaped wire reinforcement with a corrosion resistant coating layer of synthetic material and/or of a zinc alloy.

* * * * *